US006788174B1

(12) United States Patent
Afshari et al.

(10) Patent No.: US 6,788,174 B1
(45) Date of Patent: Sep. 7, 2004

(54) ADJUSTABLE MAGNETIC TRIP UNIT AND A CIRCUIT BREAKER INCORPORATING THE SAME

(75) Inventors: Farhad Afshari, Bridgeville, PA (US); Arthur D. Carothers, Beaver Falls, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/771,671

(22) Filed: Feb. 3, 2004

(51) Int. Cl.[7] ..... H01H 75/10; H01H 77/06; H01H 81/04

(52) U.S. Cl. ..... 335/42; 335/176

(58) Field of Search ..... 335/6.8–10, 21–28, 335/35–46, 172–176

(56) References Cited

U.S. PATENT DOCUMENTS 3,206,576 A 9/1965 Michetti
4,297,664 A 10/1981 Kuger et al.
4,691,182 A 9/1987 Mrenna et al.
4,958,136 A 9/1990 Maier et al.
5,394,126 A 2/1995 Grunert et al.
5,471,184 A 11/1995 Chien et al.
6,396,373 B1 5/2002 Gerdes et al.
6,407,653 B1 6/2002 Zindler et al.

*Primary Examiner*—Ramon M. Barrera
(74) *Attorney, Agent, or Firm*—Martin J. Moran

(57) ABSTRACT

The magnetic trip device of a circuit breaker has a magnetic pole in which a magnetic field is generated by load current, and an armature assembly that includes: a bracket supported for pivotal movement relative to the magnetic pole; a spring biasing the bracket to a position spaced from the magnetic pole; an armature hinged on the bracket; and an adjusting screw for adjusting a gap between the armature and the magnetic pole for calibrating the trip device without affecting the spring bias, which can be separately and independently adjusted to select the load current at which the magnetic trip is initiated.

16 Claims, 5 Drawing Sheets

ADJUSTABLE MAGNETIC TRIP UNIT AND A CIRCUIT BREAKER INCORPORATING THE SAME

BACKGROUND OF THE INVENTION

1. Field of the Invention

The invention is directed to a trip unit and a circuit breaker incorporating such a trip unit that is calibrated by adjusting a gap between a magnetic armature and magnetic yoke to which the armature is attracted by a selectable level of current in the protected circuit. The gap is adjusted without affecting the adjustable spring force that sets the current level at which the circuit breaker trips.

2. Background Information

Many circuit breakers utilize a magnetic trip unit to provide an "instantaneous" response to overcurrent or short circuit conditions. In one common type of magnetic trip unit, a magnetic yoke positioned around the load conductor focuses the magnetic field induced by the load current to attract an armature, which as it moves toward the magnetic yoke actuates the operating mechanism that opens the circuit breaker's separable contacts. The armature is biased away from the magnetic yoke by a spring. The spring force, and the gap between the armature and the magnetic yoke, affect the current at which the circuit breaker is tripped open.

The level of load current at which the circuit breaker trips varies with the feeder being protected and preference of the user. In order to accommodate a range of trip currents with a single trip unit, it is common to make the trip unit adjustable. A common range of adjustability of the trip current is five to ten times the rated current of the breaker. Typically, this adjustment is made in the spring force.

The trip unit must be calibrated at both the high and low end of trip currents to assure that the response is within tolerance, for example, plus or minus 20%. Calibration is effected by adjusting the gap between the spring biased armature and the magnetic yoke. As the magnetic yoke is fixed in position, the armature is moved, closer to the magnetic yoke to adjust the trip current downward, and away to increase the trip current. However, moving the armature in such a trip unit also changes the spring force, but in the opposite sense. Thus, while moving the armature closer to the magnetic yoke decreases the gap, tending to lower the trip current, it stretches the spring more, which increases the spring force, and therefore, the current needed to trip the breaker. In breakers with higher current ratings, the reduction in trip current produced by shortening the gap between the armature and the magnetic yoke is greater than the increase in trip current resulting from the associated stretching of the spring, so that the trip unit can be calibrated. However, in breakers with lower current ratings, the increase in trip current caused by the stretching of the spring is greater than the reduction caused by the shortening of the gap and, hence, the unit cannot be calibrated.

SUMMARY OF THE INVENTION

The present invention permits the gap between the armature and the magnetic yoke in a magnetic trip unit to be adjusted without affecting the bias force applied by the spring, thereby making it possible to calibrate such magnetic trip units regardless of the current rating. Thus, in accordance with one aspect of the invention, an adjustable magnetic trip unit for interrupting a load current through a circuit breaker comprises: a magnetic pole in which a magnetic field is generated by the load current; and an armature assembly. The armature assembly comprises a bracket supported for movement toward and away from the magnetic pole, a spring biasing the bracket to a position spaced from the magnetic pole, an armature, and a mount selectively positioning the armature on the bracket to adjust a gap between the armature and the magnetic pole. The adjustable magnetic trip unit can include in the armature assembly an adjustment mechanism selectively adjusting the bias applied by the spring to the bracket, whereby the load current, at which the magnetic field in the magnetic pole overcomes the bias applied by the spring and pulls the armature to the yoke, can be adjusted.

The mount for the armature can comprise a hinge connection and an adjustment member setting a hinge angle between the armature and the bracket. This adjustment member can comprise a threaded rod having a neck at one end. Either the armature or the bracket can have a tapped hole in which the rod is threaded while the other has a slot capturing the neck of the threaded rod.

The bracket can be elongated with a pivot member on at a first end, a first part of the hinge connection adjacent the first end and either the tapped hole or the slot adjacent the second end. In this configuration, the armature can comprise an armature paddle, an extension extending from the armature paddle and having a free end with the second part of the hinge connection adjacent the free end and with the other of either the tapped hole or the slot on the extension between the free end and the armature paddle. The bracket can have a T-shape at the first end forming the pivot member. Furthermore, the bracket can have a main body with an integral tab extending along each side toward the first end and offset from the main body to form the T-shape of the first end and configured to form the first part of the hinge connection. In this embodiment, the second part of the hinge connection on the extension of the armature comprises a T-shaped free end, and the tabs on the side edges of the bracket are configured as hooks forming the first part of the hinge connection on which the T-shaped free end of the armature extension seats.

The invention also embraces a circuit breaker incorporating this adjustable magnetic trip unit.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
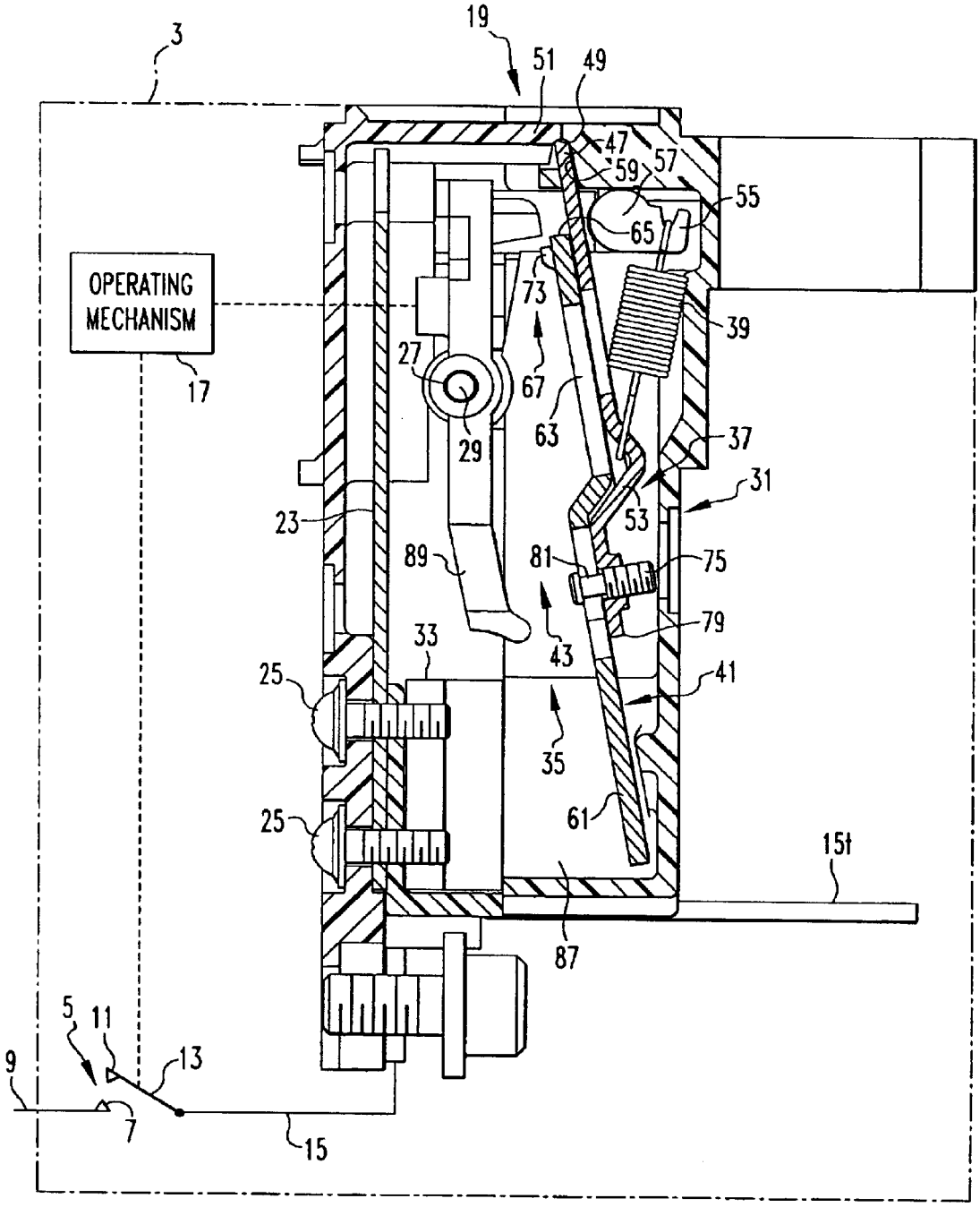
FIG. 1 is a sectional elevation view of a trip unit incorporating the invention with the remaining portion of the circuit breaker in which the trip unit is installed shown schematically.
Figure 2:
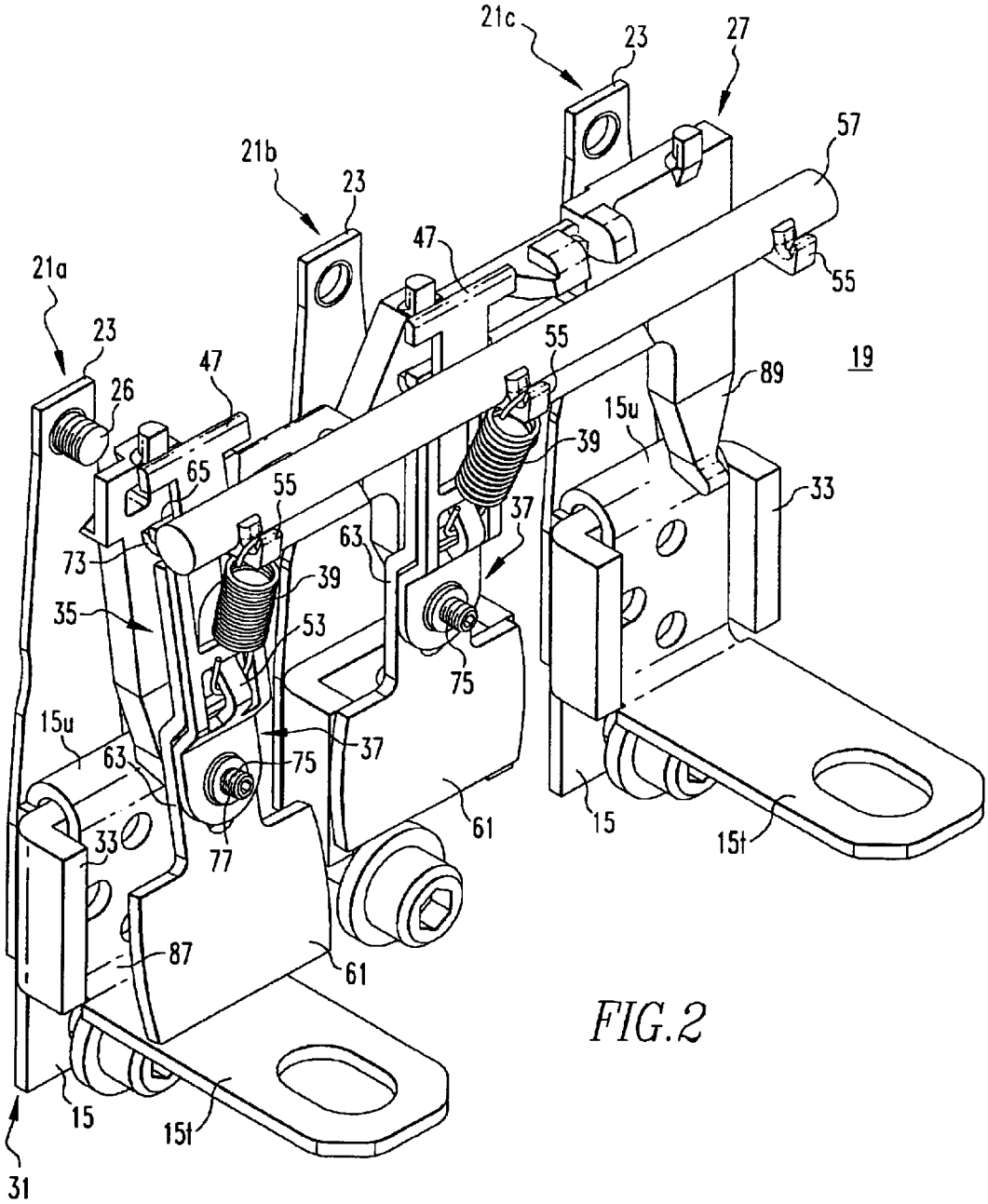
FIG. 2 is an isometric view with some parts removed for clarity of the operative portions of the trip unit shown in FIG. 1.

FIG. 1 illustrates a circuit breaker 1 with a molded housing 3 (shown schematically) containing separable contacts 5 including a fixed contact 7 affixed to a line conductor 9 and a movable contact 11 mounted on a pivoted contact arm 13 connected to a load conductor 15. The contact arm 13 is actuated by an operating mechanism 17 to open and close the separable contacts 5. The operating mechanism 17 can be operated manually by a handle (not shown) or automatically by a thermal/magnetic trip unit 19. The exemplary circuit breaker 1 is a three pole breaker so that there are three sets of separable contacts 5, one for each pole, but all operated by a single operating mechanism 17, in a manner which is well known Referring to both FIGS. 1 and 2, the thermal magnetic trip unit 19 has three poles 21*a*, 21*b*, and 21*c*. Each pole of the trip unit 19 includes a section of the load conductor 15 which is bent into an inverted U 15*u* leading to a horizontally extending terminal section 15*t*. Each pole 21*a*, 21*b*, and 21*c* has a bimetal 23 secured to the load conductor at 15*u* by screws 25. Calibrating screws 26 are screwed through the upper ends of the bimetals 23. A trip bar 27 extending across all three poles is pivotally mounted for rotation about a horizontal axis 29. As is well known, persistent overload current through the load conductor 15 of any of the poles 21*a*, 21*b*, and 21*c* heats up the associated bimetal 23 causing the free (upper) end to bend, in a clockwise direction in FIG. 1 until it contacts and rotates the trip bar 27 in a clockwise direction. This rotation of the trip bar actuates the operating mechanism 17 in a well known manner to open the separable contacts 5. The current/time at which the thermal trip occurs can be adjusted for all three poles simultaneously by axial movement of the trip bar 27 in a known manner by a thermal trip adjustment knob (not shown). The individual bimetal 23 for each pole is calibrated by the associated calibration screw 26, also in a known manner.

Figure 3:
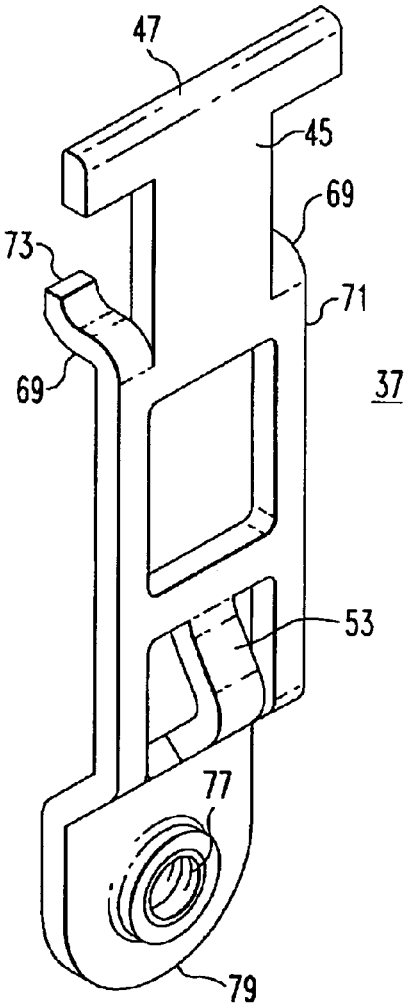
FIG. 3 is an isometric view of a bracket which forms part of a preferred embodiment of an adjustable magnetic trip unit incorporated in the trip unit of FIGS. 1 and 2.
Figure 4:
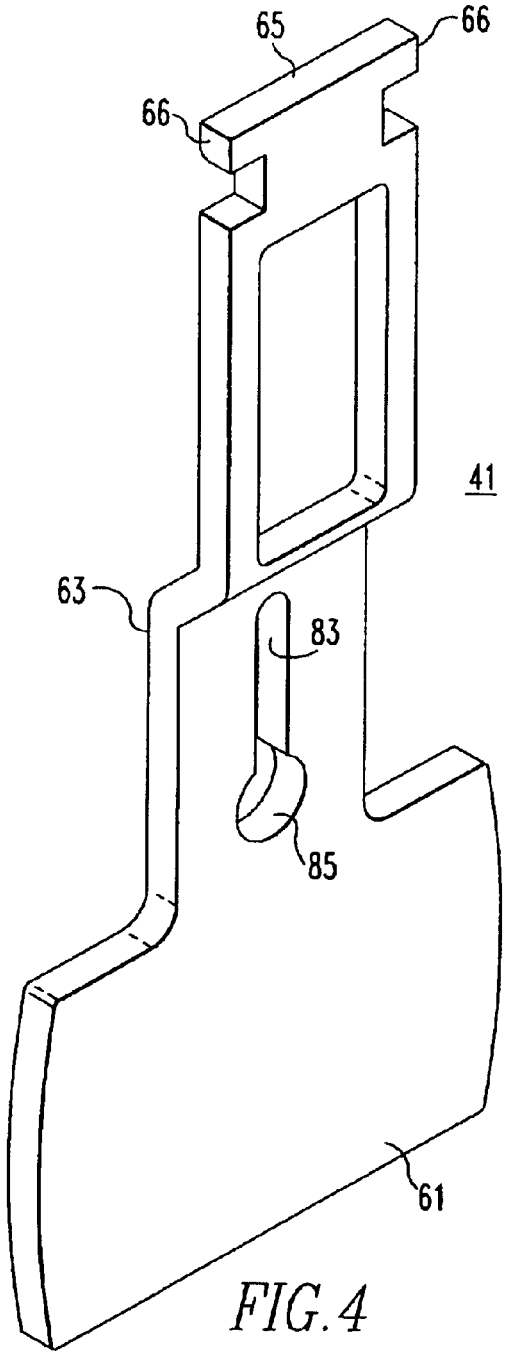
FIG. 4 is an isometric view of an armature member which also forms part of the adjustable magnetic trip assembly in accordance with the preferred embodiment of the invention.
Figure 5:
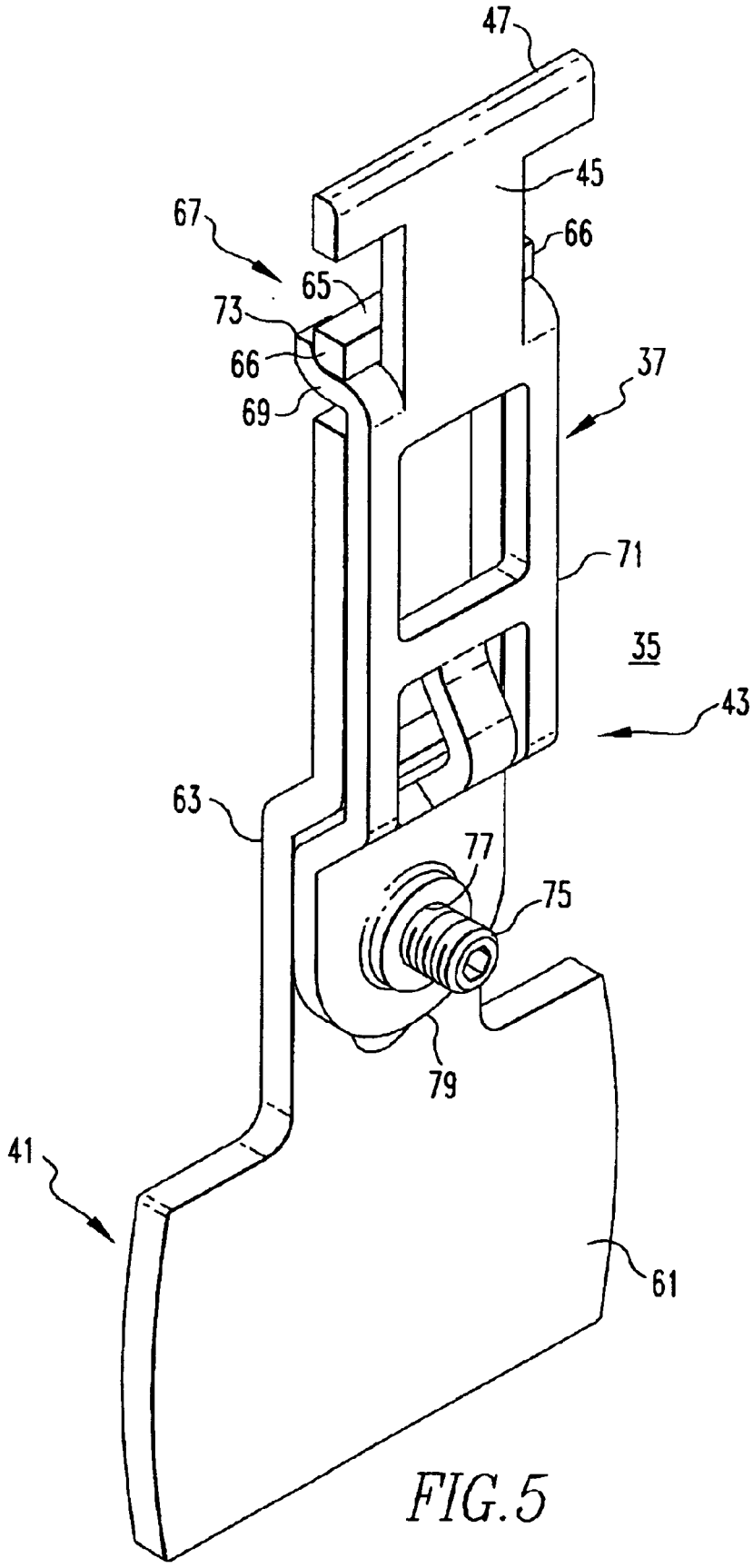
FIG. 5 is an isometric view of the preferred embodiment of the adjustable magnetic trip unit which incorporates the bracket of FIG. 3 and the armature member of FIG. 4.

An instantaneous or magnetic trip function is provided in the thermal/magnetic trip unit 19 by an adjustable magnetic trip device 31 associated with each of the poles 21*a*, 21*b*, and 21*c*. Each adjustable magnetic trip device 31 includes a magnetic pole formed by a magnetically permeable U-shaped yoke 33 captured in the U-shaped section 15*u* of the load conductor 15, and an armature assembly 35. Turning to FIGS. 3–5, in addition to FIG. 2, the armature assembly 35 includes a bracket 37 shown separately in FIG. 3, bias spring 39, an armature 41 shown separately in FIG. 4, and a mount 43 mounting the armature 41 on the bracket 37. The bracket 37 is elongated and is T-shaped at a first or upper end 45 to form a pivot member 47 that seats in a saddle 49 molded into the casing 51 of the thermal/magnetic trip unit 19. A loop 53 formed in the bracket 37 by stamping is engaged by one end of the bias spring 39. The other end of the bias spring 39, which is a helical tension spring in the exemplary armature assembly, engages a hook 55 projecting laterally from the horizontally extending magnetic trip adjustment bar 57. The bias spring 39 biases the bracket, and therefore the armature assembly 35 counterclockwise as viewed in FIG. 1 against the stop 59 formed by the wall of the casing 51.

The exemplary armature 41, as shown in FIG. 4, comprises an armature paddle 61 and an extension 63 extending from the armature paddle and having a free end 65. The mount 43 which mounts the armature 41 on the bracket 37, is a hinge connection 67 in the exemplary armature assembly 35. The first part of the hinge connection 67 is formed adjacent the first end 45 of the bracket 37 by integral tabs 69 extending toward the first end but offset from the bracket main body 71 and configured as a hook 73. The second part of the hinge connection 67 is formed by arms 66 extending laterally from the free end 65 of the armature extension 63 that seat in the hooks 73 on the bracket 37.

The mount 43 mounting the armature 41 on the bracket 37 further includes an adjustment member 75, which in the exemplary embodiment is a threaded rod. This threaded rod 75 engages a tapped hole 77 adjacent a second end 79 of the bracket 37. A neck 81 adjacent one end of the threaded rod 75 is received in a slot 83 in a keyhole opening 85 in the extension 63 on the armature 41. Alternatively, the tapped hole can be provided in the armature extension 63 with the keyhole slot in the bracket. Other adjustment members for setting the angle between the armature and the bracket can also be used.

Figure 6:
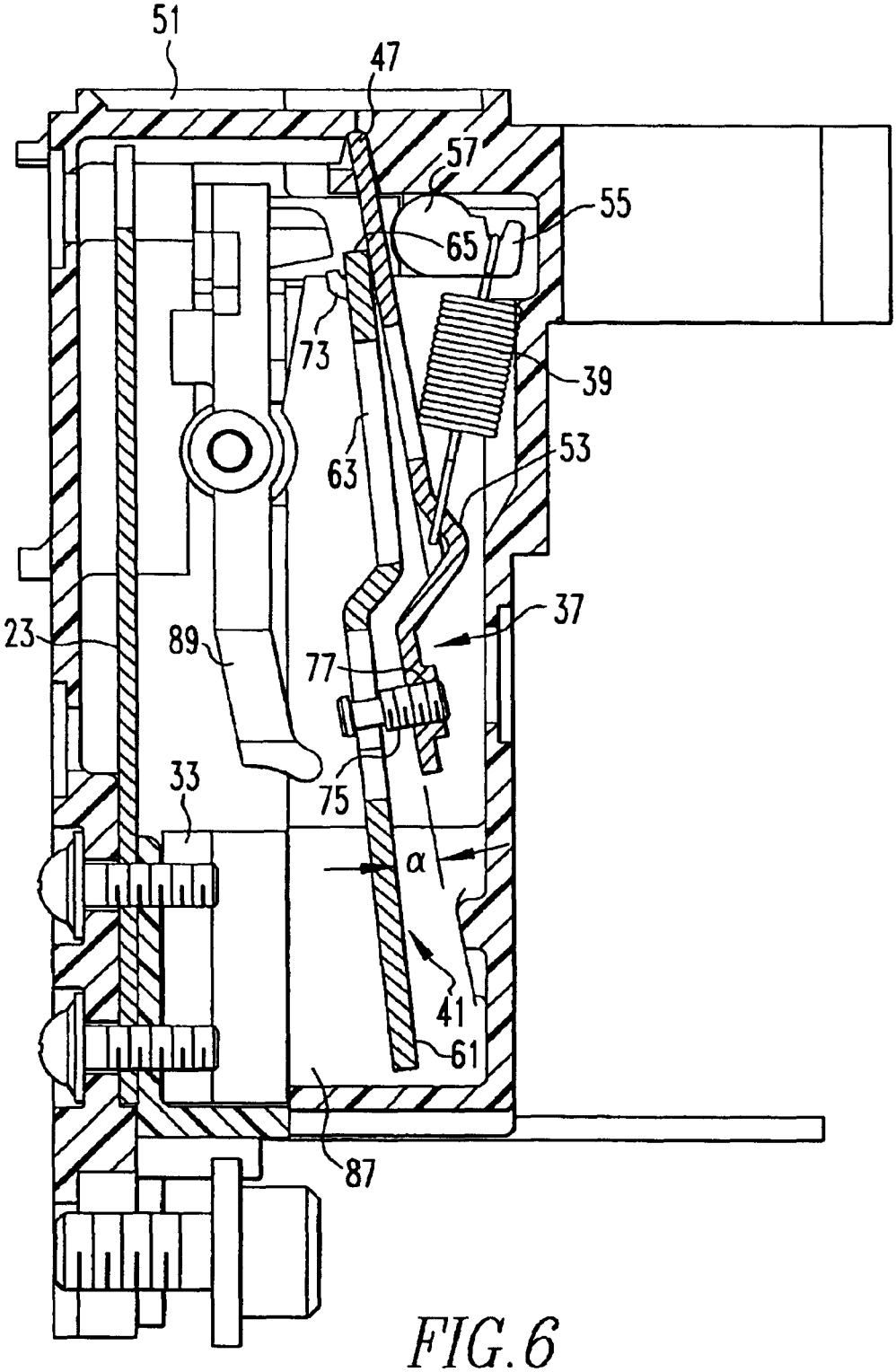
FIG. 6 is a sectional elevation view of the trip unit illustrated in FIG. 1 but shown with the adjustable magnetic trip unit shown in an exaggerated adjusted position.

As shown in FIG. 1, the spring 39 biases the armature assembly counterclockwise so that the bracket 37 seats against the stop 59 formed by the casing 51 setting a gap 87 between the armature paddle 61 and the U-shaped magnetic yoke 33. High overcurrents flowing through the separable contacts 5 and therefore the load conductor 15, such as could be produced by a short circuit, generate a magnetic field which is focused by the yoke 33 to attract the armature paddle 61 clockwise toward the yoke. Before reaching the yoke 33, the armature 41 engages an arm 89 on the lower end of the trip bar 27 thereby rotating the trip bar clockwise to actuate the operating mechanism 17 and open the separable contact 5. The magnitude of the load current at which the armature 41 is attracted to the yoke 33 is set by the bias spring 39. This trip current is simultaneously set for all three poles 21*a*, 21*b*, and 21*c* by rotation of the magnetic trip adjustment bar 57 through a single adjusting knob (not shown). The magnetic trip function is separately calibrated for each pole by rotating the threaded rod 75 to pivot the armature 41 relative to the bracket 37. FIG. 6 illustrates an exaggerated adjustment of the armature relative to the bracket while FIG. 1 illustrates full adjustment in the opposite direction.

It can be appreciated from FIGS. 1 and 6 that the magnetic trip for each individual pole can be calibrated by adjustment of the associated threaded rod 75 without having any effect on the trip level set by the spring 39.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An adjustable magnetic trip device for interrupting load current through a circuit breaker, the trip device comprising:

a magnetic pole in which a magnetic field is generated by the load current; and an armature assembly comprising:

a bracket supported for movement toward and away from the magnetic pole;

a spring biasing the bracket to a position spaced from the magnetic pole;

an armature; and a mount selectively positioning the armature on the bracket to adjust a gap between the armature and the magnetic pole.

2. The adjustable magnetic trip device of claim 1, wherein the armature assembly includes an adjustment mechanism selectively adjusting the bias applied by the spring to the bracket, whereby the load current at which the magnetic field in the magnetic pole overcomes the bias applied by the spring and pulls the armature to the magnetic pole can be adjusted.

3. The adjustable magnetic trip device of claim 1, wherein the mount comprises a hinge connection between the bracket and the armature and an adjustment member setting a hinge angle a between the armature and the bracket.

4. The adjustable magnetic trip device of claim 3, wherein the adjustment member comprises a threaded rod having a neck on one end, and wherein one of the armature and the bracket has a tapped hole in which the threaded rod is threaded and the other has a slot capturing the neck.

5. The adjustable magnetic trip device of claim 4, wherein the bracket is elongated with a first part of the hinge connection adjacent a first end, and one of the tapped hole and the slot adjacent a second end, and wherein the armature comprises an armature paddle, an extension extending from the armature paddle and having a free end with a second part of the hinge connection adjacent the free end, and with the other of the tapped hole and the slot on the extension between the free end and the armature paddle.

6. The adjustable magnetic trip device of claim 3, wherein the bracket is elongated with a pivot member at a first end supporting the bracket for pivotal movement toward and away from the magnetic pole, and having a first part of the hinge connection adjacent the first end, and wherein the armature comprises an armature paddle and an extension extending from the armature paddle and having a free end with a second part of the hinge connection adjacent the free end.

7. The adjustable magnetic trip device of claim 6, wherein the bracket has a T-shape at the first end to form the pivot member.

8. The adjustable magnetic trip device of claim 7, wherein the bracket has a main body with an integral tab extending along each side toward the first end but offset from the main body and configured to form the first part of the hinge connection.

9. The adjustable magnetic trip device of claim 8, wherein the second part of the hinge connection on the extension of the armature comprises a T-shaped free end on the extension, and wherein the tab on each side edge of the bracket is configured as a hook to form the first part of the hinge connection on which the T-shaped free end of the armature extension seats.

10. The adjustable magnetic trip device of claim 9, wherein the adjustment member comprises a threaded rod having a neck on one end, and wherein one of the extension on the armature paddle and the main body of the bracket has a tapped hole in which the threaded rod is threaded and the other has a slot capturing the neck.

11. The adjustable magnetic trip device of claim 10, wherein the one of the extension on the armature paddle and the main body of the bracket is the main body of the bracket which has the tapped hole and the other is the extension on the armature paddle that has the slot capturing the neck of the threaded rod.

12. The adjustable magnetic trip device of claim 11, wherein the armature assembly includes an adjustment mechanism selectively adjusting the bias applied by the spring to the bracket, whereby the load current at which the magnetic field in the magnetic pole overcomes the bias applied by the spring and pulls the armature to the magnetic pole can be adjusted.

13. The adjustable magnetic trip device of claim 8, wherein the integral tab extending along each side of the main body forms the T-shape of the first end of the bracket by being offset from the main body.

14. A circuit breaker comprising:

a housing;

separable contacts within the housing;

a line conductor and a load conductor connected through the separable contacts;

an operating mechanism within the housing operable to open the separable contacts when actuated; and an adjustable magnetic trip device within the housing actuating the operating mechanism and comprising:

a magnetic pole adjacent the load conductor and in which a magnetic field is generated by load current passing through the load conductor;

a bracket mounted for pivotal movement toward and away from the magnetic pole;

a spring biasing the bracket to a position spaced from the magnetic pole;

an armature; and a mount selectively positioning the armature on the bracket to adjust a gap between the armature and the magnetic pole without affecting the spring biased position of the bracket.

15. The circuit breaker of claim 14, wherein the adjustable magnetic trip device further comprises an adjustment mechanism selectively adjusting the bias applied by the spring to the bracket, whereby the load current at which the magnetic field in the magnetic pole overcomes the bias applied by the spring and pulls the armature toward the magnetic pole can be adjusted.

16. The circuit breaker of claim 15, wherein the mount comprises a hinge connection between the bracket and the armature and a threaded rod setting a hinge angle ($\alpha$) between the armature and the bracket, the threaded rod having a neck at one and wherein one of the armature and the bracket has a tapped hole in which the rod is threaded and the other has a slot capturing the neck.

* * * * *